US005542413A

United States Patent [19]

Horn

[11] Patent Number: 5,542,413

[45] Date of Patent: Aug. 6, 1996

[54] PERSONAL COOLING APPARATUS

[76] Inventor: Stephen T. Horn, R.R. 2, Box 4800, White Stone, Va. 22578

[21] Appl. No.: 401,861

[22] Filed: Mar. 10, 1995

[51] Int. Cl.[6] ..... A62B 7/02

[52] U.S. Cl. ..... 128/204.15; 128/200.24

[58] Field of Search ..... 128/204.15, 204.16, 128/200.24; 607/96, 108, 157, 179

[56] References Cited

U.S. PATENT DOCUMENTS

| | | | |
|---|---|---|---|
| 1,117,322 | 11/1914 | Sterkel | 128/204.15 X |
| 1,857,453 | 5/1932 | Henderson et al. | 128/204.15 |
| 3,140,590 | 7/1964 | Gleockler | 128/204.15 X |
| 3,507,321 | 4/1970 | Palma | 165/46 |
| 3,570,264 | 3/1971 | Curtis | 62/259.3 |
| 3,610,323 | 10/1971 | Troyer | 165/46 |
| 3,612,175 | 10/1971 | Ford et al. | 165/179 |
| 3,744,053 | 7/1973 | Parker | 2/2.16 |
| 3,999,541 | 12/1976 | Tabor | 128/204.15 X |
| 4,157,091 | 6/1979 | Pampuch | 128/202.26 |
| 4,301,792 | 11/1981 | Pasternack | 128/202.26 |
| 4,314,566 | 2/1982 | Kiwak | 128/204.15 |
| 4,914,752 | 4/1990 | Hinson et al. | 2/2 |
| 4,964,282 | 10/1990 | Wagner | 62/259.3 |
| 4,979,375 | 12/1990 | Nathans | 62/259.3 |
| 5,062,269 | 11/1991 | Zafred | 62/4 |
| 5,146,625 | 9/1992 | Steele | 2/102 |

FOREIGN PATENT DOCUMENTS

| | | | |
|---|---|---|---|
| 2338055 | 9/1977 | France | 128/204.15 |
| 2582215 | 11/1986 | France | 607/108 |
| 6503929 | 9/1965 | Netherlands | 128/204.15 |
| 212756 | 2/1968 | U.S.S.R. | 128/204.15 |
| 625707 | 9/1978 | U.S.S.R. | 128/204.15 |
| 173310 | 12/1921 | United Kingdom | 128/204.15 |
| 1008675 | 11/1965 | United Kingdom | 128/204.15 |
| 2122094 | 1/1984 | United Kingdom | 128/204.15 |
| 90/14059 | 11/1990 | WIPO | 607/96 |

*Primary Examiner*—Edgar S. Burr
*Assistant Examiner*—Eric P. Raciti

[57] ABSTRACT

The present invention comprises both the method and an apparatus to cool persons in a hot environment. It does this by providing breathing air at a temperature that would not be easily tolerated by the skin without vascular constriction and a decoupling of the cooling process. It would provide air at temperatures sometimes 100° F. or more below ambient temperatures allowing absorption of body heat to take place in the lungs. The apparatus includes a face mask and a heat sink that the air passes through as well as a heat sink to cool the blood flowing near the skin over the kidneys,

7 Claims, 1 Drawing Sheet

PERSONAL COOLING APPARATUS

FIELD OF THE INVENTION

The present invention comprises both the method and an apparatus to cool persons in a hot environment.

BACKGROUND OF THE INVENTION

There is a established need in industry for a method of cooling workers in hot environments and treating heat stress. A pressing example is the recent notice of the increase in heart attack deaths of on duty firefighters. In fact of the 34 fireground deaths of 1993 over 52% of them were reported to be from heat stressed induced heart attacks. This is attributed to the mandated use of NFPA 500 clothing or bunker gear worn by fire fighters. (Physiological Responses to Working In Bunker Gear: A Comparative Study, *Fire Engineering* 11/94)The bunker gear has reduced bum deaths to less than 5% but the hot microclimate inside has added to the cardiovascular work load. Clearly this heat stress/over-exertion induced heart attacks needs to be addressed and in a way that does not greatly increase the weight and hence work load of the fire fighter Most personal cooling devices cool the skin exclusively through conduction or evaporation with no regard for other methods. They are necessarily heavy and bulky and restrictive. The present invention uses an different method.

Cooling the chest even dramatically becomes ineffective in ambient environmental temperatures above 120° F. due to the de-coupling between the blood flow and the skin on the torso. Cooling the skin causes the small blood vessels to constrict and reduce flow. Consequently only limited cooling of the body can occur by removing heat through the skin of ones torso and therefore a full body suit becomes necessary. However by cooling the breathing air, this decoupling does not as readily occur and hence the breathing air can be cooled far greater than could be tolerated on the torso or the head.

DESCRIPTION OF PRIOR ART

Body garments for the purpose of cooling appear in the patent record taking many shapes and forms. However, most of these patents regard body garments that cool through the circulation of a cool liquid through a piping network incorporated into a garment or through the specially constructed garment itself having its own circulatory network. These devices are referred to as closed systems.

Another focus of the prior art concerns cooling apparatus that cool through evaporative means. These devices are open systems, as opposed to the closed systems mentioned above, that release cool air or vapor onto and over an individuals body to cool through evaporative means.

The present invention works in a different fashion than these above mentioned patented inventions by cooling the air which is breathed internally rather than cool the outside of the body and be consequently limited by the vasoconstriction problems encountered in other systems.

U.S. Pat. No. 3,507,321, issued to James R. Palma on Apr. 21, 1970, discloses clothing for cooling and heating the body. Palma's clothing affects the human body from the neck down by strategically locating heating coils and cooling conduits through the clothing. Temperature sensors are also incorporated into the clothing for accurate, electrical temperature control of the clothing.

U.S. Pat. No. 3,570,264, issued to Daniel L. Curtis on Mar. 16, 1971, discloses an evaporate cooling system comprising a light weight garment having a plurality of tubes connected in a parallel arrangement within the garment for the purposes of cooling the individual wearing same. This invention includes an inlet and an outlet manifold for circulating a liquid water-ammonia solution from a storage tank through the tubes. An exhaust port is also seen in fluid communication with the tubing for allowing the expended evaporant, the ammonia, to leave the system and further cool the individual.

U.S. Pat. No. 3,610,323, issued to Dan E. Troyer on Oct. 5, 1971, also discloses an evaporative cooling garment to be worn by an individual. This garment is seen as a vest-like coat having a plurality of passageways incorporated therein to create coat from these side-by-side passageways. These passageways are also seen as having a plurality of openings thereon. When used, the Troyer coat is supplied from a reservoir with a quantity of liquid coolant comprising a water and refrigerant, preferably Freon, through an inlet valve. As the body is cooled the refrigerant evaporates, leaves the system, and is replaced from the reservoir until the [such] refrgerant has been depleted. No mention of cooling the air that is breathed is mentioned or the use of a cooling belt or a cooling pack that is adjustable. For this reason, it is stated that these references do not teach the present invention.

U.S. Pat. No. 5,146,625, issued to Sandra L. Steele on Mar. 27, 1991 discloses a vest with frozen cooling packs inserted into pockets in the chest region. No mention of cooling the air that is breathed or the use of a cooling belt or the use of cooling packs that are adjustable in temperature through the use of integral insulation is taught.

U.S. Pat. No. 3,744,053, issued to Eugene K. Parker on Jul. 10, 1973, discloses liquid loop garments for heating and cooling the body of and individual. This system is a closed system, releasing no liquid or gas for either heating or cooling purposes. Parkers garments are constructed of two, liquid impervious, materials layers having insulation as well as other materials attached thereto.

Jumping ahead to U.S. Pat. No. 4,979,375 issued to Robert L. Nathans on Dec. 25, 1990, we see a mat utilizing the same type of closed system for circulating a fluid for cooling purposes that was disclosed in the Parker patent.

U.S. Pat. No. 4,998,415, issued to John D. Larsen on Mar. 12, 1991, discloses a body cooling apparatus including a tubing system for circulating a fluid that is moved not only through the tubing within the apparatus but through a compressor and a condenser in order to remove heat away from the body of an individual wearing the apparatus. Larsen's apparatus also includes a head cooling apparatus but no method of cooling the breathing air.

U.S. Pat. No. 4,964,282, issued to Christopher S. Wagner on Oct. 23, 1990, discloses a detachable bulletproof vest air conditioning apparatus. Wagner's apparatus comprises a piping system that connects to a pre-cooled air source and ducts and channels the air into the interior of the vest, between the vest and the individual, to cool the wearer of said vest. Again, we see another example of evaporative cooling with no method of cooling breathing air.

U.S. Pat. Nos. 5,062,269 and 5, 146,625 disclose body cooling devices that utilize disposable and removable cooling units. None describe either cooling the breathing air or adjustable cooling packs or cooling belts.

U S. Pat. No. 4,738,119 issued to Paolo R. Zafred on Apr. 19, 1988 discloses a garment arrangement where insulated lining material is stitched together to form pockets where tubes are placed to receive liquid carbon dioxide which then converts to solid carbon dioxide, dry ice, and then sublimates. This garment works much like an "ice vest" with the exception that frozen carbon dioxide is used rather than frozen water. According to Zafred it works by "connective and conductive cooling of the wearer". Zafred does not disclose a system operated by cooling the air that is breathed nor is his dry ice suit comparable to eutectic gel packs that are insulated and can be turned and adjusted to suit the temperature needs of the wearer. Nor does he describe a cooling belt with adjustable eutectic gel packs that can be adjusted.

U.S. Pat. 4,914,752 issued to Thomas L. Hinson and William A. Blackburn on Jan 27, 1989, describes a vortex tube supplying cooled air to the body of the wearer. Again there is no mention of cooling the breathing air or cooling packs or cooling belts.

SUMMATION OF INVENTION

The present invention will reduce body temperature by dramatically cooling the breathing air at times upward of 100° F. below ambient temperatures. For example the present invention provides 40° F. breathing air in an environment where the ambient air around the skin is 150° F. Thus the body is cooled while not causing vascular constriction of the skin.

To achieve this, a simple arrangement of a belt pack through which the breathing air flows and through which it is cooled by a mechanism such as a eutectic gel pack which is frozen but insulated from the body where a temperature no lower than approximately 60° F. contacts the body yet the air that is breathed through a face mask is radically dropped to temperatures up to 100 degrees below ambient temperatures.

The breathing air apparatus is augmented with a belt arrangement with pre- frozen yet insulated gel packs in contact with the kidney area of the back. This increases the cooling capacity of the apparatus and adds to its comfort by providing an additional body cooling system to aid the wearer. This second temperature reference effect on the kidneys is less psychologically disconcerting than just treating the breathing air alone. Both the breathing air and the cooling packs could be adjusted in temperature to achieve light weight yet efficient portable cooling. The cooling packs over the kidneys are worn next to the skin as they would be adjustable in temperature due to the variation in thickness of the integral insulation inside. The breathing air temperature is adjusted by admitting ambient air or in the case of a rebreather by recirculating some carbon dioxide removed exhaled air back in the apparatus avoiding the heat sink. This exhaust breathing air would be used to regulate the temperature of the breathing air in the apparatus.

Other variations could include the use of a helmet arrangement or cooling the air cylinder itself that the firefighter would wear by a means such as wrapping it in a flexible insulated covering filled with dry ice. Augmentation beyond just kidney cooling is envisioned.

DRAWINGS

Embodiments of the invention will now be described with reference to the drawings in which.

DESCRIPTION OF PREFERRED EMBODIMENT

Figure 1:
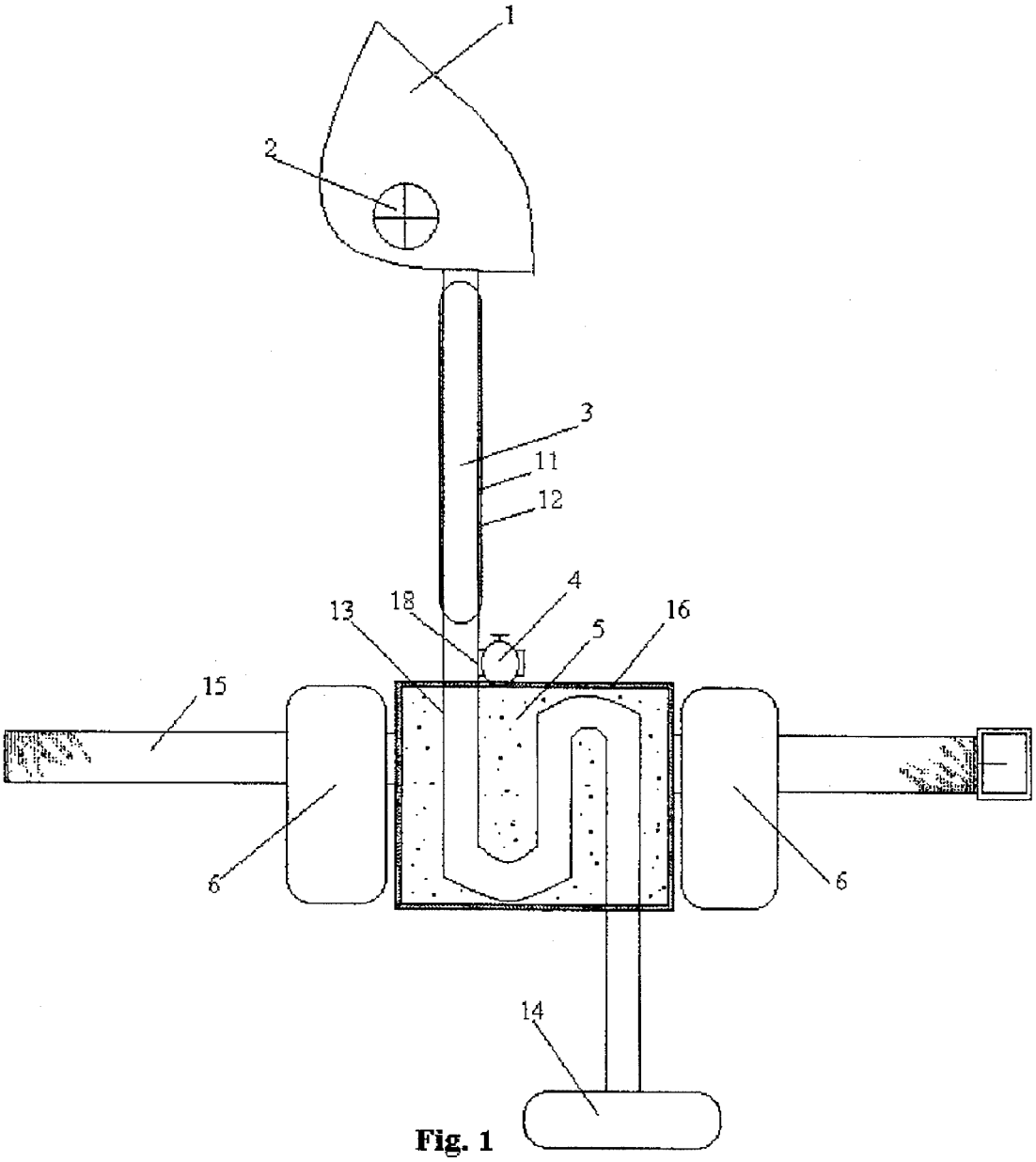
FIG. 1 is a cross sectional view of the invention.
Figure 2:
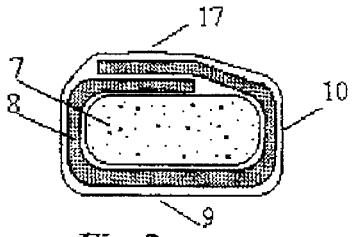
FIG. 2 is a cross sectional view of the cool pack.

Referring to the drawing figures there is shown in a preferred embodiment of the invention a face mask 1 as a gas mask is built with a one way valve exhaust valve 2 and said face mask connected to an insulated conduit 3 comprised of an inner plastic hose 11 surrounded with insulation 12. On the breathing hose there is a tee fitting 18 attached valve 4 which allows ambient air to be drawn in with very cold air so an adjustment of temperature is possible. The breathing hose 3 goes on to connect to a serpentine ribbed copper tube 13 that passes through a heat sink composed of a heat absorbent material which could be a deeply frozen eutectic gel or dry ice 5. The air in the copper tube upon being drawn in or fed from a source 14 is cooled as it is swirled next to the large surface area of the ribbed tube 13, Thus very cold air is fed to the lungs of the wearer. The apparatus is supported and attached to a belt 15 which goes around the waist of the wearer. The heat absorbing material such as in this case a eutectic gel or dry ice 5 is insulated from the wearer with insulation 16. On either side 5 are cooling packs 6 which would tend to ride over the kidneys. They are comprised of a frozen eutectic gel 7 covered with a layer of flexible insulated material 8 covering it in such a way that on one side there would be two layers of insulation 17 and on the other a single layer 9. Thus one side would be a different temperature than the other on the surface. The inventor has his adjusted so the single side 9 maintains a temperature of 60° F. and the double insulated side 17 is 72° F. This entire cooling pack 6 is then wrapped and sealed in a plastic sheath 10.

The wearer first loads the pre - frozen cooling packs or mechanism 5 and 6 in the belt and adjusts the temperature which will be in physical contact to him by deciding which side of the cooling pack will be next to him. The wearer then attaches the belt so the pack is in the back resting in the small of his back. The face mask is put on and the temperature of the breathing air is adjusted by opening tee fitting attached valve 4. Thus a person can then work in quite high temperatures with out sweating or discomfort. The apparatus can include air filters or supplied compressed air source 14.

The air could also be cooled by such methods as free expansion as described by Charles's law or from endothermic chemical reactions or ice or mechanical refrigeration heat sinks or heat exchanger. And although the present invention has been described with respect to specific details, it is not intended that such details limit the scope of this patent other than set forth these claims.

I claim:

1. A breathing apparatus for delivering cooled breathing air to a patient comprising:

a source of respirable gas;

an insulated housing defining a volume, said housing having upper, lower and lateral surfaces, said lower surface having an inlet and said upper surface having an outlet, said inlet being in fluid communication with said source of respirable gas;

a ribbed copper tube inside said housing connecting said inlet to said outlet, said ribbed copper tube being surrounded by a heat absorbent material substantially filling said volume;

a valve connected to the outlet external to said housing, said valve being selectively in communication with said outlet and the ambient;

a conduit having a first end connected downstream of said valve and having a second end connected to a breathing mask;

a first and a second cold pack located at each of said lateral surfaces of said insulated housing externally thereof, said cold packs covering the kidney region of a wearer when the breathing apparatus is donned.

2. The breathing apparatus of claim 1, wherein said ribbed copper tube is serpentine in shape.

3. The breathing apparatus of claim 1, wherein said valve further comprises a tee fitting.

4. The breathing apparatus of claim 1, wherein said heat absorbent material is dry ice.

5. The breathing apparatus of claim 1, wherein said heat absorbent material is eutectic gel.

6. The breathing apparatus of claim 1, wherein said first and second cold packs further each comprise an insulative wrap.

7. The breathing apparatus of claim 5, wherein said insulative wrap is of sufficient length such that, when wrapped about a respective cold pack, a region of overlap is defined so as to selectively afford a double layer of insulation in said region of overlap.

* * * * *